United States Patent [19]

Matarese

[11] Patent Number: 4,993,984

[45] Date of Patent: Feb. 19, 1991

[54] DISCRETIONARY MOSAIC ART KIT

[76] Inventor: Anthony G. R. Matarese, 27 Lake Home St., Rochester, N.Y. 14612

[21] Appl. No.: 465,425

[22] Filed: Jan. 16, 1990

[51] Int. Cl.[5] ..... A63H 33/06; A63F 39/00; G09B 19/00; E04B 5/04

[52] U.S. Cl. ..... 446/118; 273/282; 434/96; 52/608; 52/384

[58] Field of Search ..... 446/118, 117, 104, 110, 446/113, 119, 92; 273/160, 282; 434/96, 97, 150; 52/608, 384, 386, 82

[56] References Cited

U.S. PATENT DOCUMENTS

| | | | |
|---|---|---|---|
| 510,178 | 12/1893 | König | 434/94 |
| 964,065 | 7/1910 | Snedeker | 434/150 |
| 1,306,246 | 6/1919 | Bried | 52/608 |
| 1,439,359 | 12/1922 | Estes | 273/157 R |
| 1,557,165 | 10/1925 | Hooper | 52/608 |
| 1,893,944 | 1/1933 | Johnson | 434/96 |
| 2,199,719 | 5/1940 | Brothers | 273/282 R |
| 2,280,609 | 4/1942 | Williamson | 273/157 |
| 2,309,494 | 1/1943 | Berg | 273/282 R X |
| 2,759,295 | 8/1956 | Keuls | 446/118 |
| 3,174,753 | 3/1965 | Miller | 273/157 |
| 3,242,594 | 3/1966 | Smith | 434/96 |
| 3,574,017 | 4/1971 | Kass | 434/81 X |
| 3,581,882 | 6/1971 | Bish | 434/81 X |
| 3,625,149 | 12/1971 | Allen | 434/96 X |
| 3,703,293 | 11/1972 | Nekton | 273/282 R |
| 3,755,923 | 9/1973 | Krahn | 434/96 |
| 3,921,312 | 11/1975 | Fuller | 434/96 |
| 4,138,116 | 2/1979 | Siders | 273/157 |
| 4,143,496 | 3/1979 | Destito | 52/511 X |
| 4,183,167 | 1/1980 | Jatich | 446/118 |
| 4,515,370 | 5/1985 | Garcia | 273/258 |
| 4,603,863 | 8/1986 | Meyer | 273/282 |
| 4,754,979 | 7/1988 | Vaseen | 273/292 |

FOREIGN PATENT DOCUMENTS

| | | | |
|---|---|---|---|
| 2427073 | 12/1975 | Fed. Rep. of Germany | 52/608 |
| 1576436 | 6/1969 | France . | |
| 319974 | 4/1957 | Switzerland . | |
| 3099 | of 1911 | United Kingdom | 434/96 |
| 951140 | 3/1964 | United Kingdom | 434/81 |

*Primary Examiner*—Mickey Yu
*Assistant Examiner*—D. Neal Muir
*Attorney, Agent, or Firm*—Marjama & Pincelli

[57] ABSTRACT

A discretionary mosaic art kit which comprises a support board arranged so as to selectively accommodate individual pieces of design creating elements at a selected location on said board, and a plurality of design creating elements in the form of an equilateral triangle, each adapted to be fixed to said board at a selected location.

11 Claims, 5 Drawing Sheets

DISCRETIONARY MOSAIC ART KIT

BACKGROUND OF THE INVENTION

Various puzzles and art kits for forming a predetermined pattern or puzzle and discretionary mosaic puzzles have been taught in the art. For example, U.S. Pat. No. 2,759,295 illustrates a design-forming toy which enables the user to form an infinite variety of designs or figures embodying three-dimensional as well as multicolored effects. The device employs a number of design-forming elements which may be selectively placed at the discretion of the user, and adhered to a board using a recess and stem interlocking system. The discretionary pieces may be multi-colored and comprise a variety of forms or designs such as stars, circles, and the like.

Various puzzle assemblies and board games utilizing triangular pieces are set forth in U.S. Pat. Nos. 4,138,116 and 4,515,370, respectively. U.S. Pat. No. 4,138,116 is directed to a puzzle which is solved as a perfect square and consists of sixteen congruent isosceles-like triangles. The task is to solve the puzzle so that the periphery of the square is uninterrupted by any round corners. U.S. Pat. No. 4,515,370 is directed to a board game having a first and second plurality of triangular areas and a plurality of opposing sets of playing pieces movable on the board. Each playing piece has at least two substantially flat sides so that it may be used or flipped from one triangular area to another triangular area.

Swiss Patent No. 319,974 teaches the use of a discretionary mosaic puzzle in which a mosaic of the desired configuration is formed by using isosceles and right triangles. Optionally, the mosaic may be confined within a frame, but no means are provided for fixing or fastening the triangular pieces to any backing. The pieces may have various colors. It is required that the base of the isosceles triangle be the same length as the base of the right triangle. Equilateral triangles are not disclosed.

It is an object of the present invention to provide a discretionary mosaic art kit through which the user can create at his discretion a work of art which may be permanently viewed as an art object, or at the option of the user, later dismantled and re-assembled to provide a new configuration or work of art.

It is a further object of the present invention to provide the user with a kit which has a limitless potential for combined design shapes and color patterns.

SUMMARY OF THE INVENTION

The present invention is directed to a discretionary mosaic art kit which comprises a support board arranged so as to accommodate individual pieces of design-creating elements at a selected location on the board. The individual pieces are in the shape of an equilateral triangle and are provided in a variety of colors. Each design-creating element has at least one connecting means which provides for integral mating of the element at a selected location on the board. The kit provides the user with the option to change the design or pattern during assembly at any point on the board either by moving or changing an element or the color of an element. The user may form any desirable, creative design that he wishes in any combination of suitable colors.

DETAILED DESCRIPTION OF THE DRAWINGS

Figure 1:
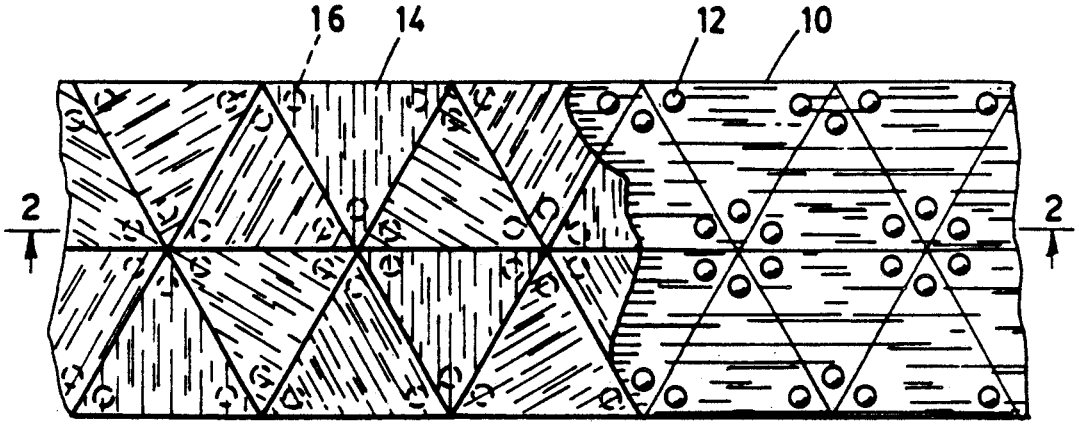
FIG. 1 is a top elevational view of a section of a support board and design pieces used in the present invention.

The discretionary mosaic art kit of the present invention is illustrated by FIG. 1 in which a support board 10 comprising a plurality of raised portions 12 arranged in a predetermined configuration is adapted to receive a recess from a design-creating element or piece 14 containing a recessed portion 16. The design-creating piece 14 is in the form of an equilateral triangle which may comprise a multiplicity of colors.

Figure 2:
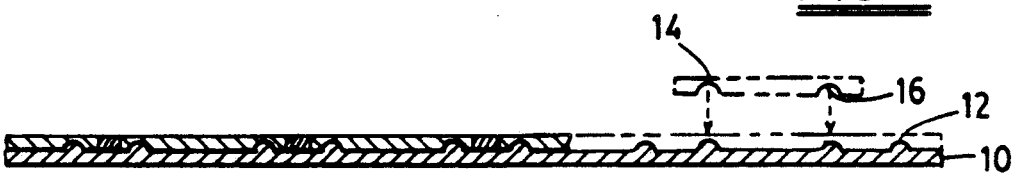
FIG. 2 is a sectional view through line 2 of FIG. 1.
Figure 3:
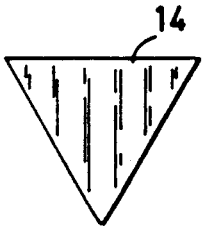
FIG. 3 is a top elevational view of a design-creating element of the present invention.
Figure 4:
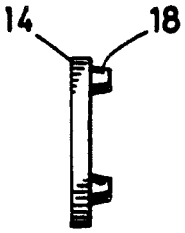
FIG. 4 is a side view of the element of FIG. 3.
Figure 5:
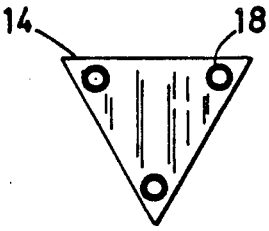
FIG. 5 is a bottom view of the design element of FIG. 3.
Figure 6:
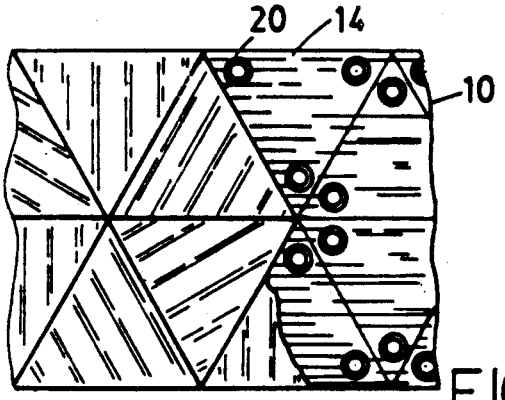
FIG. 6 is a top elevational view of a section of the board and design pieces illustrating the design pieces of FIGS. 3–5.
Figure 7:
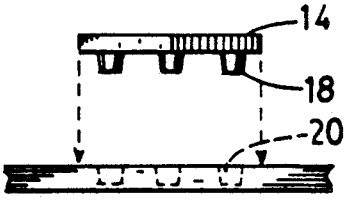
FIG. 7 is a side sectional view illustrating the interlocking means of the design pieces and board illustrated in FIG. 6.

As illustrated in FIG. 2, the recessed portion 16 of each design-creating piece 14 is adapted to mate with raised portion 12 of board 10 in order to secure each piece 14 in place at the desired selected location on the board.

FIGS. 3–7 illustrate an alternative embodiment in which a stem portion 18 is contained on the triangular piece 14 and a complimentary recessed portion 20 is contained in the board. Both the pieces and the board may be made of pressed paper board, molded plastic, wood, or any other suitable material. The pieces 14 can be made of any desirable color or shades of colors in order to enable the user to form colored patterns or print designs by arranging the pieces. Preferably, each design-creating element 14 shall have a recessed area or a stem portion at or near the three angled corners of the piece in order to provide maximum security of the piece to the backing board and to provide maximum alignment of the pieces. It should be understood, however, that one or more securing means may be used at any desired location.

Alternatively, securing means other than interlocking may also be used such as suction means, heat-sensitive adhesives, or any other fixing means.

Figure 8:
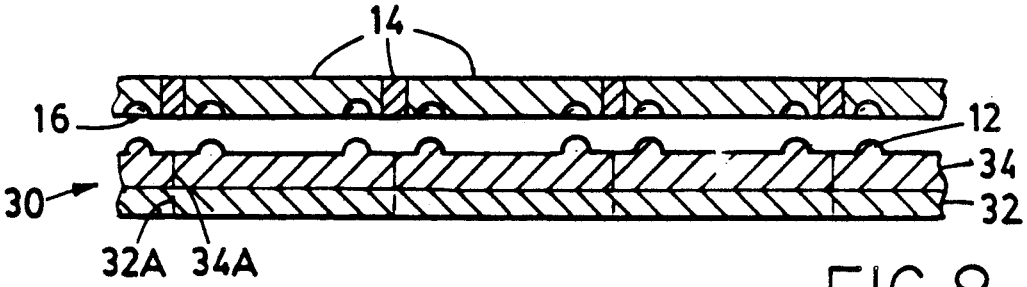
FIG. 8 is a sectional view illustrating an alternative construction design for the kit of the present invention.
Figure 9:
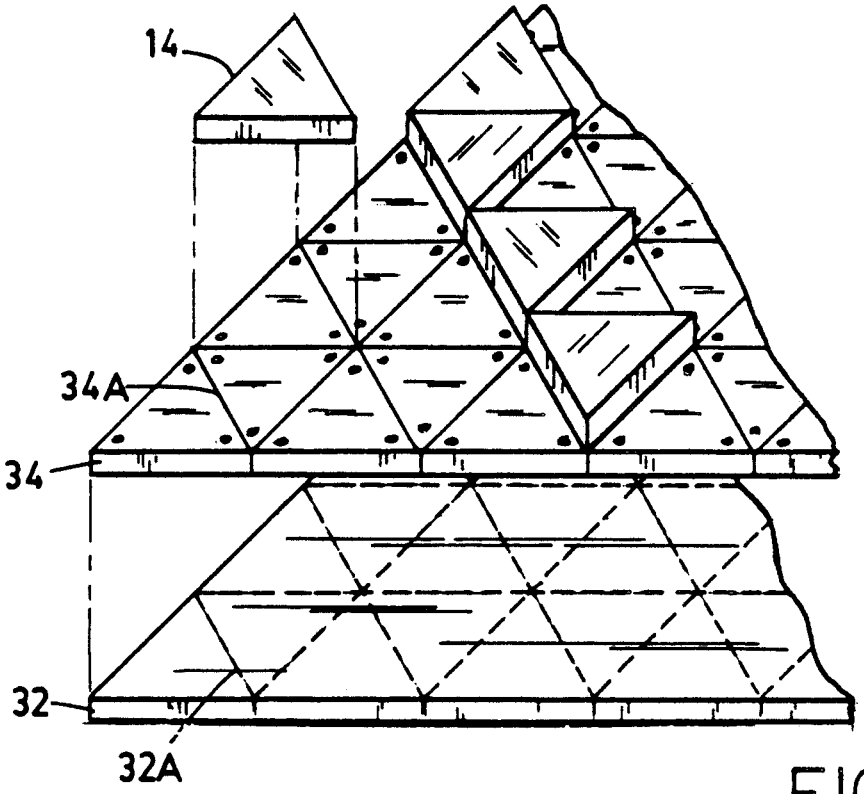
FIG. 9 is an exploded view illustrating the components of FIG. 8.

In a preferred alternative embodiment illustrated in FIGS. 8 and 9, the board and design creating elements may be constructed in the form of a laminated press-bond paper. In this embodiment a composite base 30 comprising a sub-layer 32 which contains perforations 32A is overlayed with a layer 34 which has cut vertical stations 34A. The perforations 32A and cut sections 34A are in the form of a plurality of equilateral triangles which identically correspond in size and shape to design elements 14 which may be placed thereon at the discretion of the user. A coating of a heat activated adhesive, not shown, may be put on either the underface of puzzle element 14 or the top upper surface of layer 34, and once the desired mosaic formed by mating puzzle pieces 14 with the upper surface of layer 34 has been completed, the remaining portion of composite base 30 comprising layers 32 and 34 is torn or stripped away from the mosaic along perforation 32A and cut sections 34A. The resulting self-contained mosaic contained on composite base 30 may be mounted on any board or hung on a wall. The puzzle pieces 14 may be permanently fixed in place on base 30 by applying heat, such as with a hand iron which activates the heat activated adhesive material. FIG. 9 is an exploded view which illustrates the various components for this embodiment in which the puzzle elements 14 and corresponding cut and perforated sections are superimposed over each other to better illustrate the relationship of the components.

Figure 10:
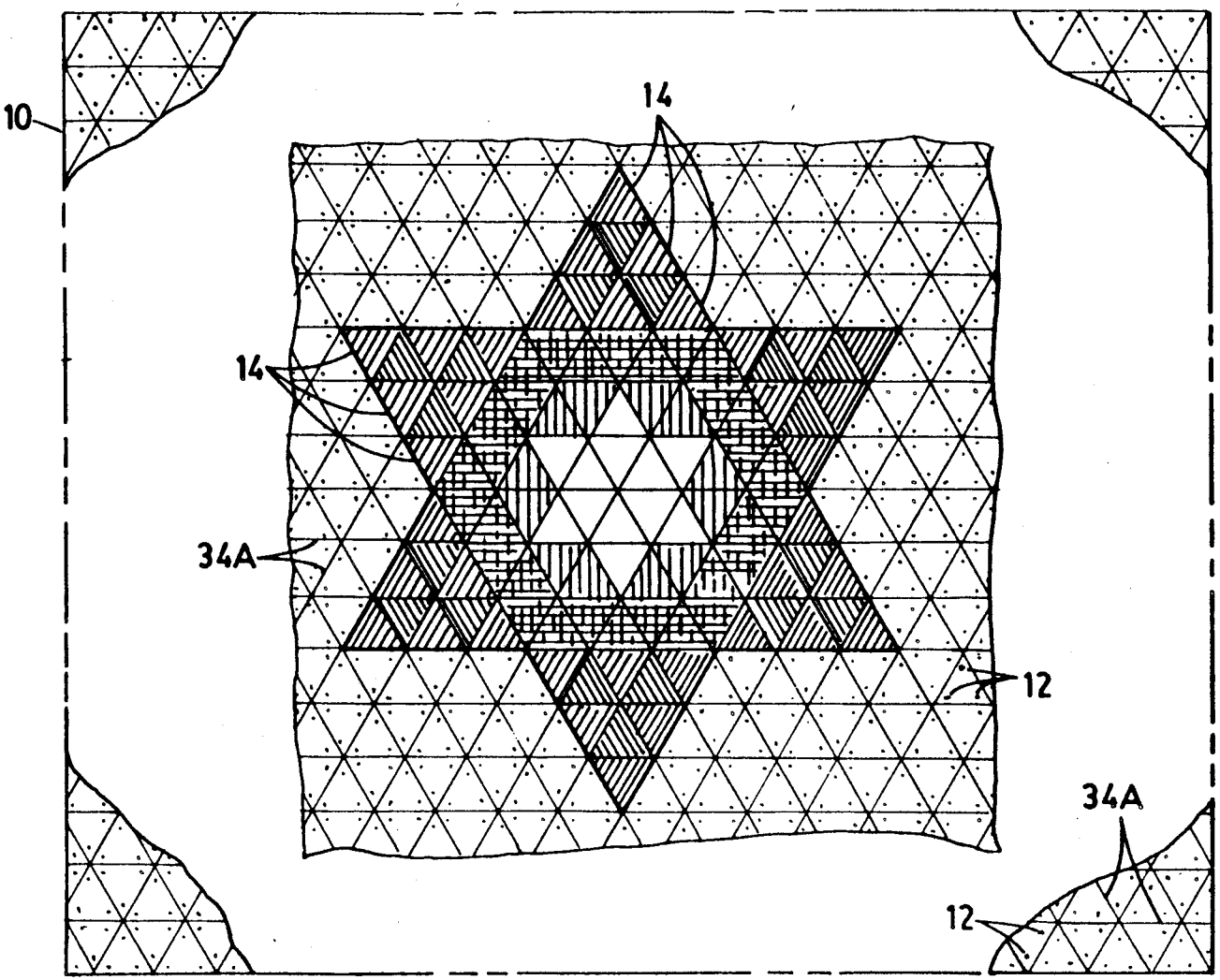
FIG. 10 is a top elevational view illustrating a discretionary mosaic formed by the present invention.

FIG. 10 illustrates a discretionary mosaic in the form of a star formed of a variety of colored puzzle pieces contained on a support board in which the predetermined locations for the puzzle pieces are in the form of an equilateral triangle which surround the star. The solid line background triangular locations contained on the support board may either comprise those illustrated by FIGS. 1–7 in which puzzle elements 14 are removably fixed in place on the board, or alternatively, the solid lines may illustrate those of the cut layer 34A in which the remainder of the board is stripped away from the mosaic star after heat sealing to base layer 30.

The design of the present invention created by the user, are entirely discretionary, and when using the various colors of the design pieces, may be used to create pleasing works of art which may be suitably framed and mounted on walls or any other desired location. The kit is usable by all ages due to its adaptability to be manufactured in various sizes to consider the fine-motor ability of the user. It maximizes the user's cognitive thought processes for creativity by minimizing assembly effort. Furthermore, it provides the highest degree of creative value, e.g., artistic, entertaining, educational, therapeutic.

Figure 11:
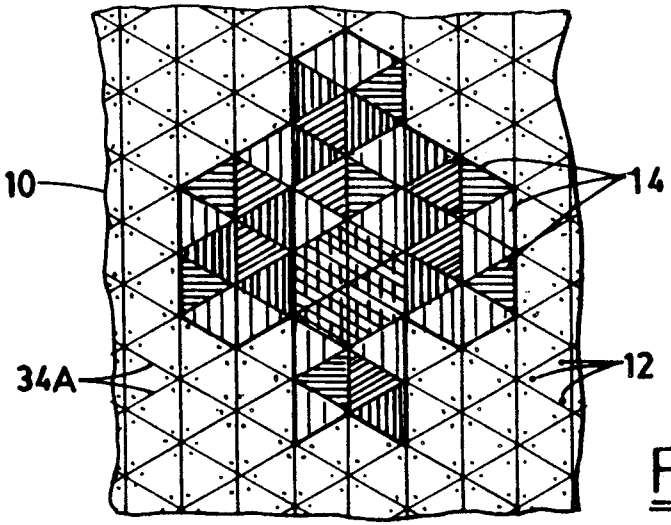
FIG. 11 is a top elevational illustrating a further embodiment of a discretionary mosaic formed by the present invention.
Figure 12:
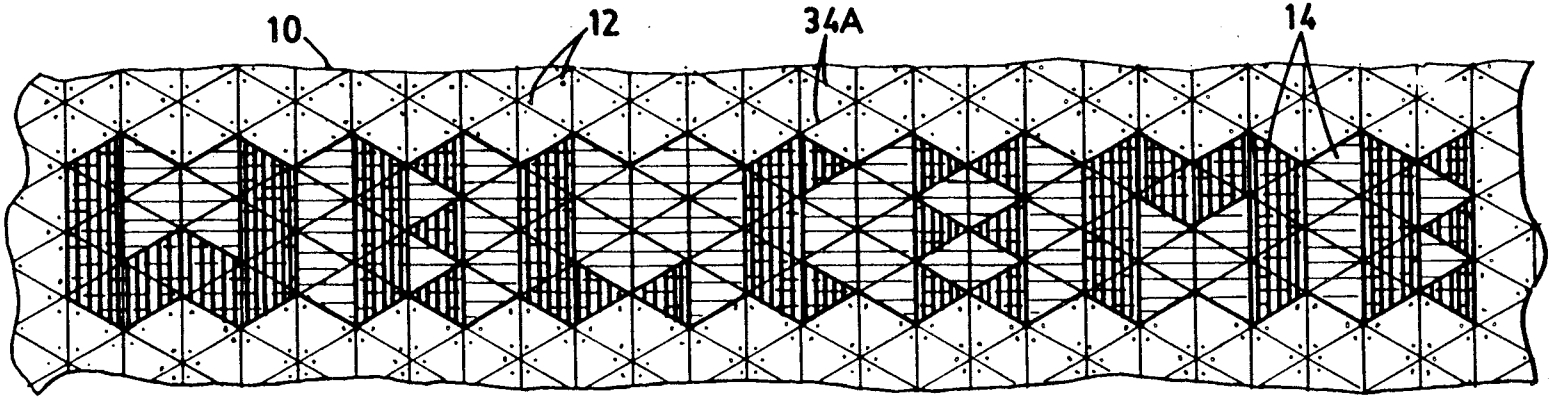
FIG. 12 is a top view illustrating a further embodiment of a discretionary mosaic formed by the present invention.
Figure 13:
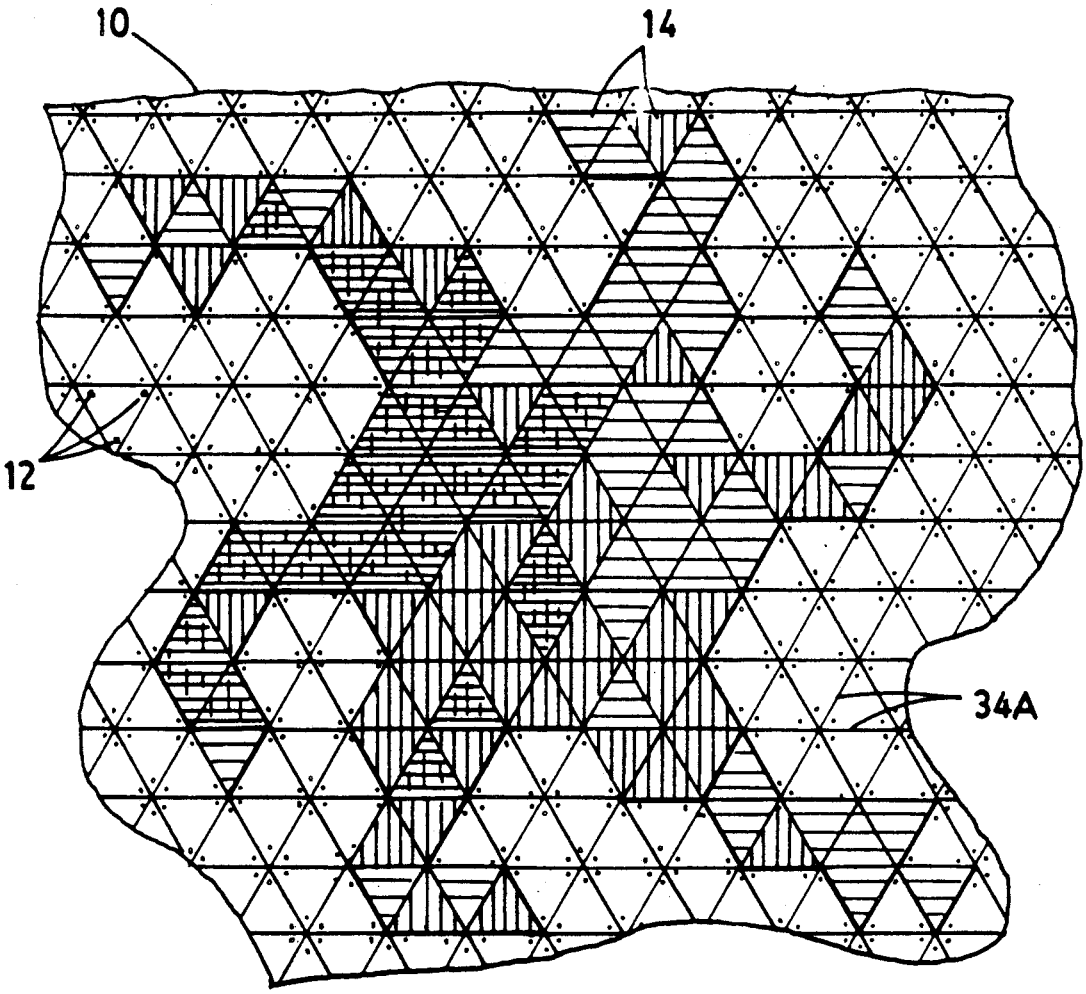
FIG. 13 is a top elevational view illustrating yet another embodiment of a discretionary mosaic formed by the present invention.

FIG. 11 illustrates a mosaic design in the form of a thunderbird, while FIG. 12 illustrates the word "WELCOME" in the colored or hatched portions of the design. FIG. 13 is a further rendition of another novel discretionary mosaic design.

The solid lines in triangular form provided on the support board enable the user to easily place the complementary equilateral triangular design creating elements in the desired location on the board. The specific advantage of equilateral triangles provides for total discretion with regard to the use and placement of each piece in that each side of the design element is equal in length and, hence, allows for an infinite combination of geometrical designs and colors without the resort to the use of interlocking-type pieces as is common for conventional puzzles.

Although particular embodiments of the present invention have been disclosed herein for purposed of explanation, it should be understood that further modifications or variations thereof, will be apparent to those skilled in the art to which this invention pertains.

I claim:

1. A discretionary mosaic art kit which consists of:

(a) a portable support board arranged so as to selectively accommodate individual pieces of design creating elements at a selected location on said board;

(b) a plurality of flat design creating elements in the form of an equilateral triangle, each adapted to be fixed to said board at a selected location so as to present a substantially flat uninterrupted surface; and (c) connecting means located adjacent each of the three corners of said design creating elements in the form of interlocking stems or recesses which are adapted to mate with complementary recesses or stems at said selected locations on said board.

2. The kit of claim 1 in which the selected location for the design creating elements contained on the board comprise a visual outline comprising a continuous array of equilateral triangles juxtapositioned in contact with each other.

3. A mosaic art kit which consists in combination of a portable support board having a plurality of selected locations for placement of design creating elements, and a plurality of flat design creating elements in the form of an equilateral triangle, such that said elements may be arranged on said support board in a discretionary manner to form a desired design having a substantially flat uninterrupted surface, connecting means located adjacent each of the three corners of said design creating elements in the form of interlocking stems or recesses which are adapted to mate with complementary recesses or stems at said selected locations on said board.

4. The kit of claim 3 in which said elements are made of a plurality of colors.

5. A discretionary mosaic art kit which consists of:

(a) a portable support board arranged so as to selectively accommodate individual pieces of design creating elements at a selected location on said board;

(b) a plurality of flat design creating elements in the form of an equilateral triangle, each adapted to be fixed to said board at a said selected location;

(c) with said support board being pre-cut and/or perforated along dimensions consonant with said design creating elements in order to allow for any portions of the unused support board to be stripped away from the fixed design creating elements; and (d) means for fixing said design creating elements to said support board.

6. The kit of claim 5 in which connecting means are located at each of the three corners of the triangular element.

7. The kit of claim 5 in which said elements are made of a plurality of colors.

8. The kit of claim 5 in which the support board and design creating elements contain complimentary connecting means.

9. The kit of claim 5 in which the design creating elements are held in place with an adhesive.

10. The kit of claim 5 in which the selected location for the design creating elements contained on the board comprise a visual outline comprising a continuous array of equilateral triangles juxtapositioned in contact with each other.

11. The kit of claim 7 in which the support board is made of paper board.

* * * * *